US008851330B1

(12) United States Patent
Chen

(10) Patent No.: US 8,851,330 B1
(45) Date of Patent: Oct. 7, 2014

(54) PRESS-ON COSMETIC CONTAINER

(71) Applicant: Sin-Hsiung Chen, Tainan (TW)

(72) Inventor: Sin-Hsiung Chen, Tainan (TW)

( * ) Notice: Subject to any disclaimer, the term of this patent is extended or adjusted under 35 U.S.C. 154(b) by 40 days.

(21) Appl. No.: 13/840,146

(22) Filed: Mar. 15, 2013

(51) Int. Cl.

| | |
|---|---|
| ***B67D 7/84*** | (2010.01) |
| ***B05B 11/00*** | (2006.01) |
| ***B65D 83/38*** | (2006.01) |
| *B65D 77/06* | (2006.01) |

(52) U.S. Cl.
CPC ..... *B05B 11/0037* (2013.01); *B65D 77/065* (2013.01); *B65D 83/384* (2013.01)
USPC ..... 222/160; 222/183

(58) Field of Classification Search
CPC ..... B05B 11/0037; B56D 77/065; B65D 83/384; B65D 83/386; B65D 83/388
USPC ..... 222/160, 453, 153.04, 628, 183, 171, 222/214, 522, 525; 401/99, 109, 117
See application file for complete search history.

(56) References Cited

U.S. PATENT DOCUMENTS

| | | | | |
|---|---|---|---|---|
| 4,624,594 | A | 11/1986 | Sasaki et al. | |
| 7,874,461 | B2 * | 1/2011 | Bae | 222/153.13 |
| 7,874,753 | B2 * | 1/2011 | Domy et al. | 401/99 |
| 8,353,636 | B2 * | 1/2013 | Drugeon et al. | 401/107 |
| 8,714,412 | B2 * | 5/2014 | Benigni et al. | 222/153.13 |
| 2006/0285911 | A1 * | 12/2006 | Demellier | 401/75 |
| 2009/0302062 | A1 * | 12/2009 | Maddy | 222/183 |
| 2013/0140330 | A1 * | 6/2013 | Christophe et al. | 222/153.13 |

FOREIGN PATENT DOCUMENTS

| | | |
|---|---|---|
| EP | 2095883 | 9/2009 |
| FR | 2606298 | 5/1988 |
| JP | 6345164 | 12/1994 |
| WO | 2012/168643 | 12/2012 |

OTHER PUBLICATIONS

English Translation of Abstract of WO 2012/168643 published Dec. 13, 2012.
English Translation of Abstract of EP 2095883 published Sep. 2, 2009.
English Translation of Abstract of JP 6345164 published Dec. 20, 1994.
English Translation of Abstract of FR 2606298 published May 13, 1988.
Extended European Search Report for Application No. 13159371.7 dated Sep. 26, 2013.

* cited by examiner

*Primary Examiner* — Lien Ngo
(74) *Attorney, Agent, or Firm* — WPAT, P.C.; Anthony King

(57) ABSTRACT

A press-on cosmetic container has a main tube, an inner tube, a spring and an actuator. The main tube has multiple positioning protrusions and multiple sliding slots. The inner tube has multiple ribs. Two ends of the spring respectively abut the main tube and the inner tube. The actuator is mounted between the main tube and the inner tube and pushes the ribs, such that the ribs are revolved and each rib is positioned alternately through the sliding slots and abutting the positioning protrusions of the main tube. A user can hold the press-on cosmetic container with one single hand to allow a sprayer of a bottle mounted in the cosmetic container to protrude outside or to be stored inside, which is convenient for use.

20 Claims, 6 Drawing Sheets

PRESS-ON COSMETIC CONTAINER

BACKGROUND OF THE INVENTION

1. Field of the Invention

The present invention relates to a cosmetic container, especially to a press-on cosmetic container.

2. Description of the Prior Art(s)

A conventional cosmetic container has a bottle, a sprayer, and an end cap. The bottle is used to store cosmetic fluid, such as perfume, toner, or the like. The sprayer is mounted on an upper opening of the bottle. The end cap is detachably mounted on the bottle and around the sprayer. When a user is to dispense the cosmetic fluid from the conventional cosmetic container, the user has to detach the end cap from the bottle first and then presses the sprayer. Thus, a suction assembly that is connected to the sprayer draws the cosmetic fluid and the sprayer sprays out the cosmetic fluid. After using the cosmetic fluid, the end cap has to be mounted on the bottle and around the sprayer again to prevent the sprayer from being accidentally pressed and dispensing cosmetic fluid.

However, since the end cap has to be detached from the bottle whenever dispensing the cosmetic fluid stored in the conventional cosmetic container, once the end cap is not mounted on the bottle properly after use, the sprayer is very likely to be accidentally pressed and sprays out the cosmetic fluid by accident. Moreover, the user has to detach the end cap from the bottle and to mount the end cap back on the bottle, and said acts must be done with two hands since one hand has to hold the bottle. This further hinders convenience in use.

To overcome the shortcomings, the present invention provides a press-on cosmetic container to mitigate or obviate the aforementioned problems.

SUMMARY OF THE INVENTION

The main objective of the present invention is to provide a press-on cosmetic container. The cosmetic container has a main tube, an inner tube, a spring and an actuator. The main tube has multiple positioning protrusions and multiple sliding slots formed on an inner surface of the main tube. The inner tube has multiple ribs formed on an outer surface of the inner tube. Two ends of the spring respectively abut the main tube and the inner tube. The actuator is mounted between the main tube and the inner tube and pushes the ribs of the inner tube, so that the ribs are revolved and each rib is positioned alternately through the sliding slots of the main tube and abutting the positioning protrusions of the main tube.

A user can hold the press-on cosmetic container with one single hand to allow a sprayer of a bottle mounted in the cosmetic container to protrude out of the cosmetic container or retract inward to be stored in the cosmetic container, which is convenient for operating.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
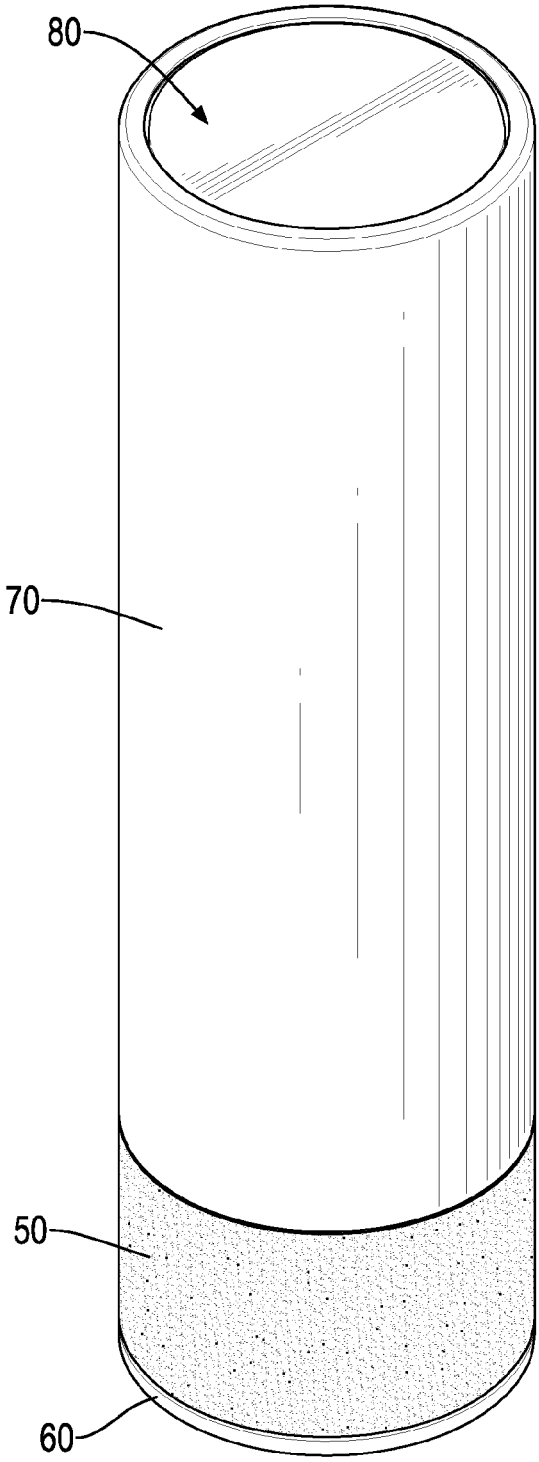
FIG. 1 is a perspective view of a press-on cosmetic container in accordance with the present invention.
Figure 2:
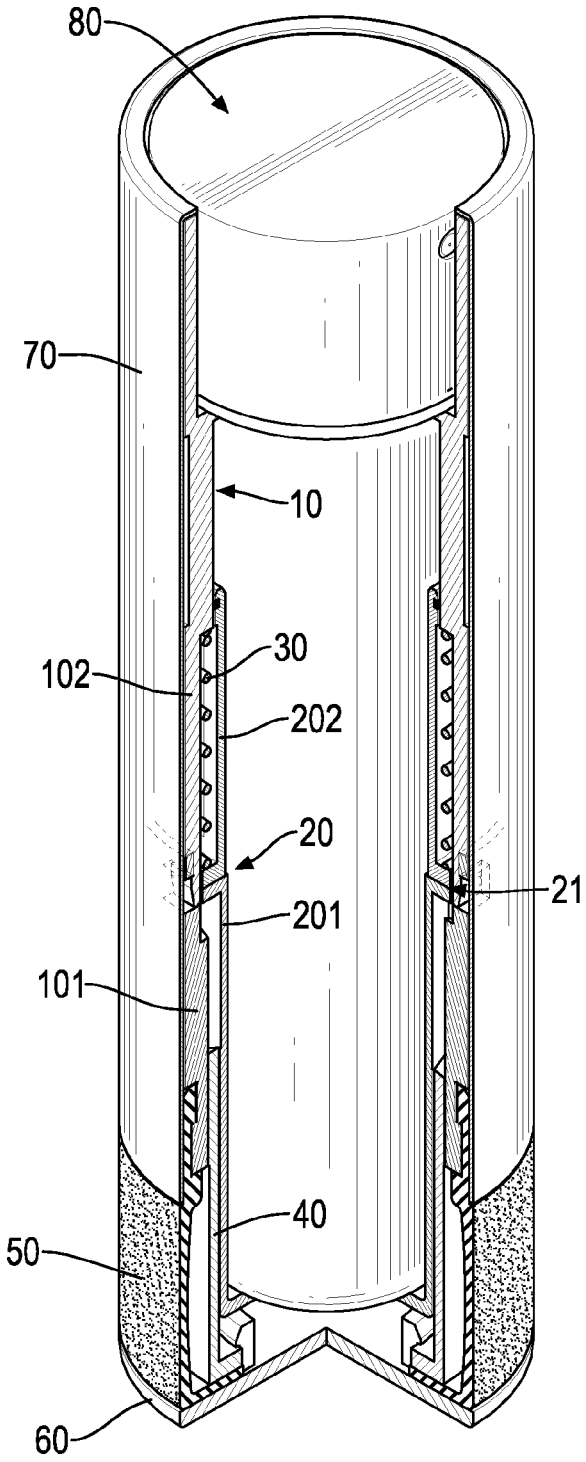
FIG. 2 is a cross-sectional perspective view of the press-on cosmetic container in FIG. 1.
Figure 3:
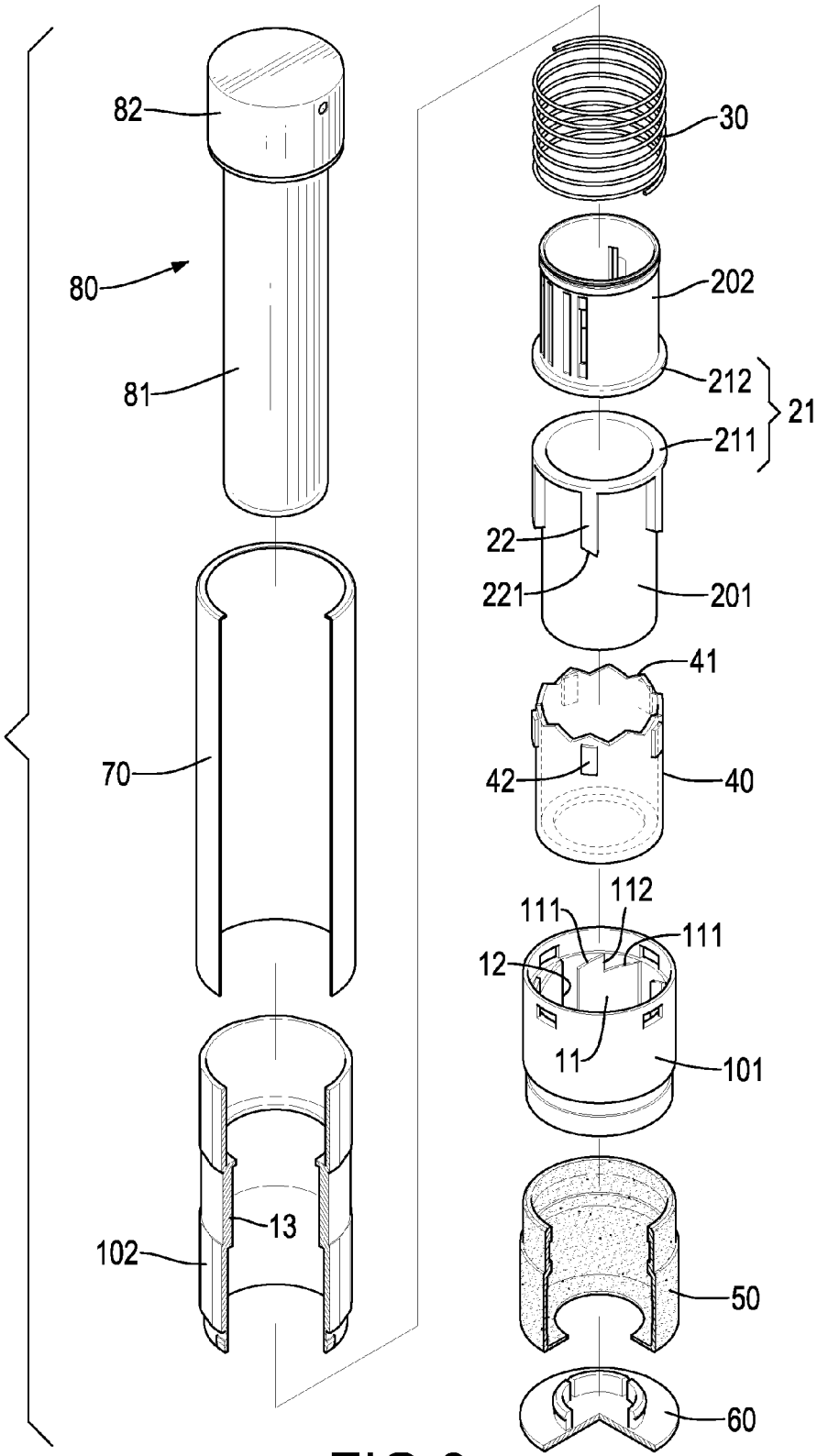
FIG. 3 is an exploded perspective view of the press-on cosmetic container in FIG. 1.

With reference to FIGS. 1 to 3, a press-on cosmetic container in accordance with the present invention comprises a main tube 10, an inner tube 20, a spring 30, an actuator 40, a resilient sleeve 50, an end button 60, and an outer tube 70.

The main tube 10 has an inner surface, an outer surface, a lower open end, an upper open end, multiple positioning protrusions 11, multiple sliding slots 12, and a limiting protrusion 13.

The positioning protrusions 11 are separately formed on and arranged around the inner surface of the main tube 10, and are disposed adjacent to the lower open end of the main tube 10. Each positioning protrusion 11 has an upper end, two beveled edges 111 and a longitudinal edge 112. The beveled edges 111 of the positioning protrusion 11 are formed on the upper end of the positioning protrusion 11 and slant in the same direction. The longitudinal edge 112 has two ends respectively connected to the beveled edges 111 of the positioning protrusion 11.

Each sliding slot 12 extends longitudinally and is defined between two of the positioning protrusions 11 that are adjacent to each other. Each sliding slot 12 has an upper open end and a lower open end.

The limiting protrusion 13 is formed around the inner surface of the main tube 10 and is disposed between the upper open end of the main tube 10 and the positioning protrusions 11.

Specifically, the main tube 10 comprises a guiding tube 101 and an outer mounting tube 102. The guiding tube 101 has an inner surface, an upper peripheral edge, and a lower end. The outer mounting tube 102 has an inner surface and a lower peripheral edge corresponding to and securely connected to the upper peripheral edge of the guiding tube 101. Specifically, the lower peripheral edge of the outer mounting tube 102 and the upper peripheral edge of the guiding tube 101 are securely connected to each other via engaging protrusions and engaging holes to form the main tube 10. The positioning protrusions 11 and the sliding slots 12 of the main tube 10 are formed on the inner surface of the guiding tube 101. The limiting protrusion 13 of the main tube 10 is formed on the inner surface of the outer mounting tube 102.

Figure 4A:
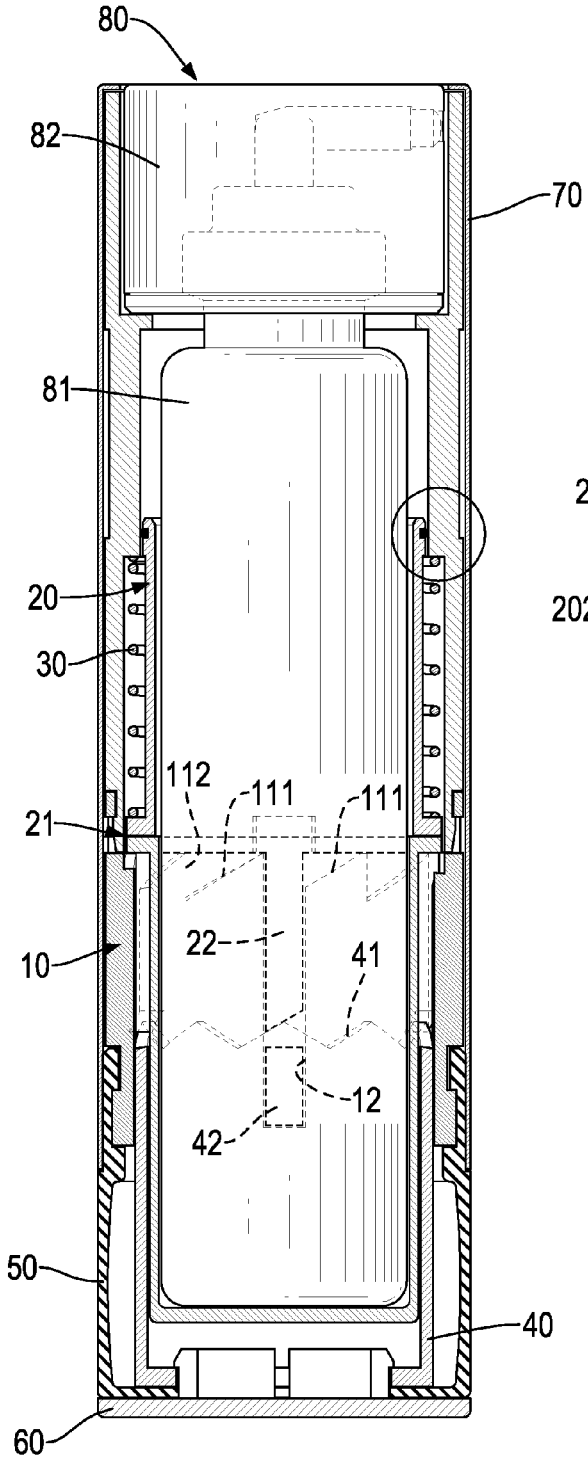
FIG. 4A is a side view in partial section of the press-on cosmetic container in FIG. 1, showing a bottle stored in the press-on cosmetic container.
Figure 4B:
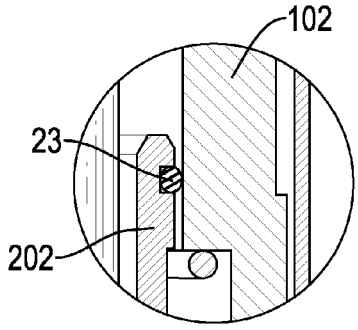
FIG. 4B is an enlarged side view in partial of the press-on cosmetic container in FIG. 4.

With further reference to FIGS. 4A and 4B, the inner tube 20 is mounted in the main tube 10 and has an upper end, a lower end, an outer surface, a flange 21, multiple ribs 22 and an O-ring 23. The upper end of the inner tube 20 is open. The lower end of the inner tube 20 is closed.

The flange 21 is formed around the outer surface of the inner tube 20 and is disposed between the positioning protrusions 11 and the limiting protrusion 13 of the main tube 10.

The ribs 22 are separately formed on and arranged around the outer surface of the inner tube 20, and are disposed between the flange 21 and the lower end of the inner tube 20. The ribs 22 are selectively revolved such that each rib 22 is positioned alternately through the sliding slots 12 of the main tube 10 and abutting the longitudinal edges 112 and the beveled edges 111 of the positioning protrusions 11 of the main tube 10. Each rib 22 extends longitudinally and has a lower end and a beveled edge 221. The beveled edge 221 of the rib 22 is formed on the lower end of the rib 22, and selectively leans against one of the beveled edges 111 of a corresponding positioning protrusion 11 to allow the rib 22 to slide along the beveled edge 111 of the corresponding positioning protrusion 11.

The O-ring 23 is mounted around the outer surface of the inner tube 20, is disposed adjacent to the upper end of the inner tube 20, and abuts the limiting protrusion 13 of the main tube 10.

Specifically, the inner tube 20 comprises a positioning tube 201 and an inner mounting tube 202. The positioning tube 201 has an outer surface, an upper end that is open, a lower end that is closed, and a first lateral protrusion 211. The first lateral protrusion 211 is formed on the outer surface of the positioning tube 201 and around the upper end of the positioning tube 201. The inner mounting tube 202 has an outer surface, an upper end that is open, a lower end that is open, and a second lateral protrusion 212. The second lateral protrusion 212 is formed on the outer surface of the inner mounting tube 202 and around the lower end of the inner mounting tube 202, and abuts the first lateral protrusion 211 to form the flange 21 of the inner tube 20. The ribs 22 of the inner tube 20 are formed on the outer surface of the positioning tube 201. The O-ring 23 of the inner tube 20 is mounted around the outer surface of the inner mounting tube 202 and is disposed adjacent to the upper end of the inner mounting tube 202.

The spring 30 is mounted around the inner tube 20 and is disposed between the upper end of the inner tube 20 and the flange 21. The spring 30 has two ends respectively abutting the limiting protrusion 13 of the main tube 10 and the flange 21 of the inner tube 20. Thus, the spring 30 pushes the inner tube 20 to move toward the lower open end of the main tube 10. Specifically, the spring 30 is mounted around the inner mounting tube 202 of the inner tube 20. The ends of the spring 30 respectively abut the limiting protrusion 13 of the main tube 10 and the second lateral protrusion 212 of the inner mounting tube 202.

The actuator 40 is tubular, is mounted around the lower end of the inner tube 20 and is slidably disposed between the inner tube 20 and the main tube 10. The actuator 40 has a lower end, an outer surface, an upper peripheral edge 41, and multiple guiding protrusions 42. The upper peripheral edge 41 of the actuator 40 is serrate. The guiding protrusions 42 are separately formed on and arranged around the outer surface of the actuator 40, and are respectively mounted slidably in the sliding slots 12 of the main tube 10.

The resilient sleeve 50 is made of resilient and soft material and has a lower end and an upper end. The upper end of the resilient sleeve 50 is securely mounted on the lower open end of the main tube 10. Specifically, the upper end of the resilient sleeve 50 is securely mounted on the lower end of the guiding tube 101 of the main tube 10.

The end button 60 is mounted on the lower end of the resilient sleeve 50 and is securely connected to the actuator 40. Specifically, the end button 60 is securely connected to the lower end of the actuator 40 via a split plug and holds the lower end of the resilient sleeve 50 between the end button 60 and the actuator 40.

The outer tube 70 is mounted around the main tube 10 and the upper end of the resilient sleeve 50 to form a smooth appearance. Information about cosmetics stored in the press-on cosmetic container can be labeled on an outer surface of the outer tube 70.

With reference to FIGS. 2 and 3, a bottle 80 receiving cosmetic fluid, such as perfume, toner or the like is stored in the press-on cosmetic container. The bottle 80 has a bottle body 81 and a sprayer 82. The bottle body 81 is mounted in the inner tube 20. The sprayer 82 is mounted on an upper end of the bottle body 81 and is disposed between the limiting protrusion 13 and the upper open end of the main tube 10.

With further reference to FIG. 4A, when the ribs 22 of the inner tube 20 are respectively mounted through the sliding slots 12 of the main tube 10, the spring 30 pushes the inner tube 20, so that the ribs 22 of the inner tube 20 abut the upper peripheral edge 41 of the actuator 40. Then the whole bottle 80 is received in the press-on cosmetic container for the time being.

Figure 5:
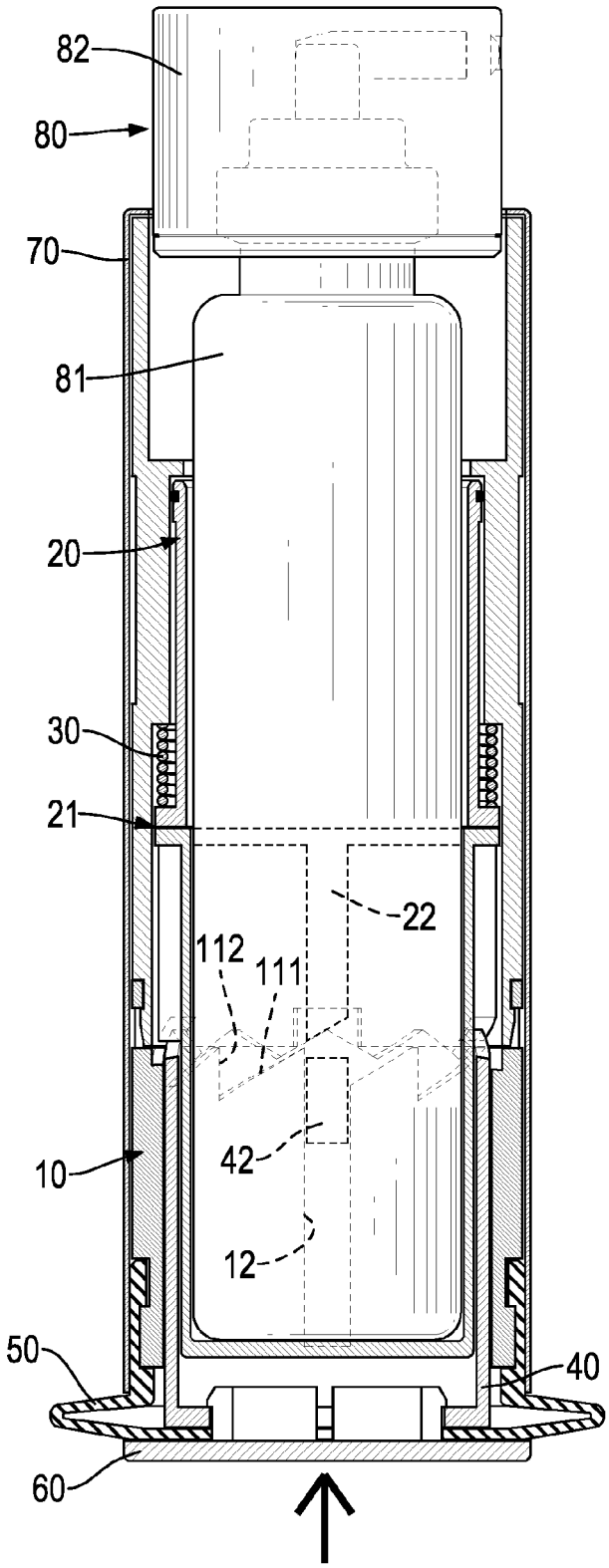
FIG. 5 is an operational side view in partial of the press-on cosmetic container in FIG. 1.

With further reference to FIG. 5, when a user presses the end button 60 to drive the actuator 40, the resilient sleeve 50 deforms, and the guiding protrusions 42 of the actuator 40 slide along the sliding slots 12 of the main tube 10 and respectively push the ribs 22 of the inner tube 20 to slide along the sliding slots 12 of the main tube 10. Thus, the inner tube 20 and the bottle 80 move toward the upper open end of the main tube 10 and the sprayer 82 of the bottle 80 protrudes out of the main tube 10.

Figure 6:
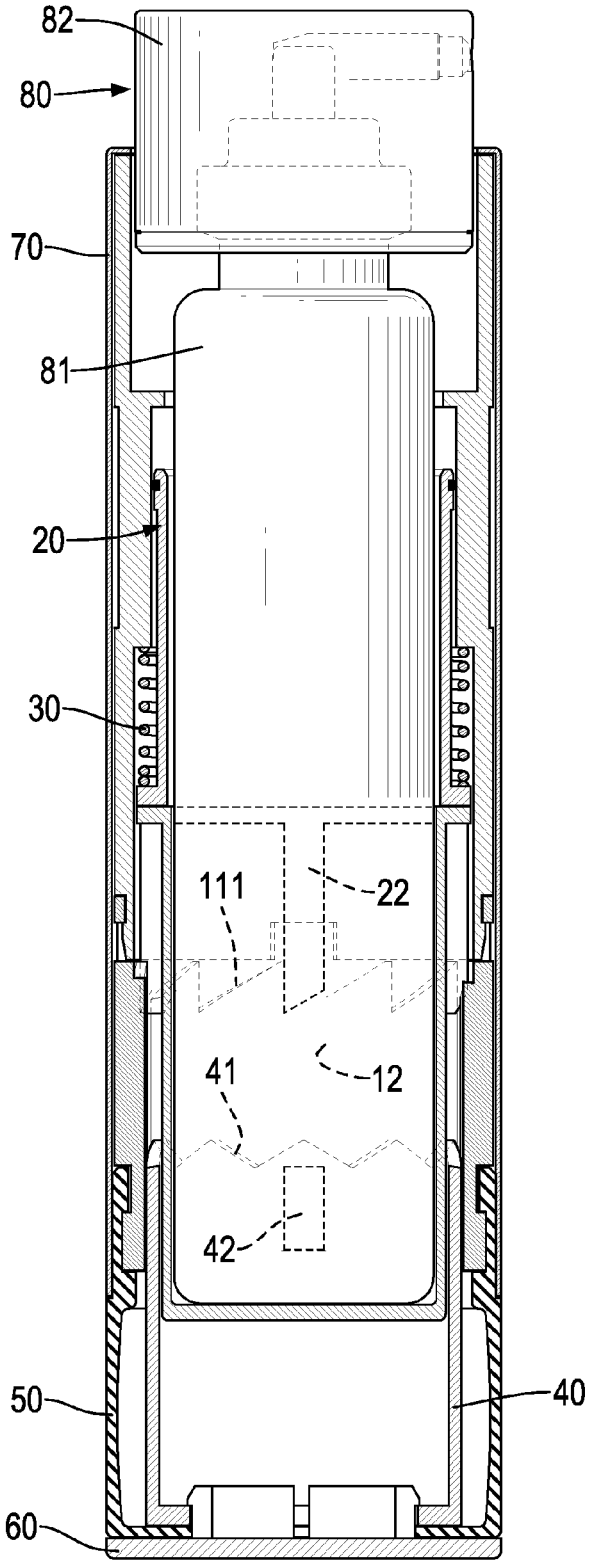
FIG. 6 is another side view in partial section of the press-on cosmetic container in FIG. 1, showing the bottle protruding out of the press-on cosmetic container.

With further reference to FIG. 6, with the spring 30 pushing the inner tube 20, when the beveled edge 221 of each rib 22 is moved to one of the beveled edges 111 of the corresponding positioning protrusions 11 of the main tube 10, the beveled edge 221 of the rib 22 leans against and slides along the beveled edge 111 of the corresponding positioning protrusion 11. Thus, the inner tube 20 is forced to rotate relative to the main tube 10 until the ribs 22 of the inner tube 20 abut the longitudinal edges 112 of the positioning protrusions 11. Then the sprayer 82 of the bottle 80 remains protruding out of the press-on cosmetic container. The user can press the sprayer 82 to spray out the cosmetic fluid that is stored in the bottle 80.

After using the cosmetic fluid, the user presses the end button 60 again to drive the actuator 40, so that the guiding protrusions 42 of the actuator 40 respectively push the ribs 22 of the inner tube 20. As the beveled edge 221 of each rib 22 is moved to an upper end of the longitudinal edge 112 of the corresponding positioning protrusion 11 of the main tube 10, the beveled edge 221 of the rib 22 leans against and slides along the other beveled edge 111 of the corresponding positioning protrusion 11 to force the inner tube 20 to rotate relative to the main tube 10 again. With the spring 30 pushing the inner tube 20, the ribs 22 slide into the sliding slots 12 of the main tube 10 again and the whole bottle 80 is received in the press-on cosmetic container.

The press-on cosmetic container as described has the following advantages. The user can hold the press-on cosmetic container with one single hand to press the end button 60 and to allow the sprayer 82 of the bottle 80 to protrude out of the press-on cosmetic container or retract inward to be received in the press-on cosmetic container, which is convenient for operating. Moreover, since no cap is needed for the sprayer 82, no cap would be lost or loosened from the cosmetic container, and the sprayer 82 would not be accidentally pressed and spray out the cosmetic fluid.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A press-on cosmetic container comprising:

a main tube having an inner surface;

an upper open end;

multiple positioning protrusions separately formed on and arranged around the inner surface of the main tube, and each positioning protrusion having an upper end;

two beveled edges formed on the upper end of the positioning protrusion and slanting in the same direction; and a longitudinal edge having two ends respectively connected to the beveled edges of the positioning protrusion;

multiple sliding slots, and each sliding slot extending longitudinally and defined between two of the positioning protrusions that are adjacent to each other; and a limiting protrusion formed around the inner surface of the main tube and disposed between the upper open end of the main tube and the positioning protrusions;

an inner tube mounted in the main tube and having an upper end;

a lower end;

an outer surface;

a flange formed around the outer surface of the inner tube and disposed between the positioning protrusions and the limiting protrusion of the main tube; and multiple ribs separately formed on and arranged around the outer surface of the inner tube and disposed between the flange and the lower end of the inner tube, and each rib extending longitudinally;

a spring mounted around the inner tube and disposed between the upper end of the inner tube and the flange; and an actuator being tubular, mounted around the lower end of the inner tube, slidably disposed between the inner tube and the main tube, and having an outer surface;

an upper peripheral edge; and multiple guiding protrusions separately formed on and arranged around the outer surface of the actuator, and respectively mounted slidably in the sliding slots of the main tube; wherein the ribs are selectively revolved such that each rib is positioned alternately through the sliding slots of the main tube and abutting the longitudinal edges and the beveled edges of the positioning protrusions of the main tube; and when the ribs of the inner tube are respectively mounted through the sliding slots of the main tube, the spring pushes the inner tube, so that the ribs of the inner tube abut the upper peripheral edge of the actuator.

2. The press-on cosmetic container as claimed in claim 1, wherein each rib of the inner tube has a lower end and a beveled edge formed on the lower end of the rib and selectively leaning against one of the beveled edges of a corresponding positioning protrusion.

3. The press-on cosmetic container as claimed in claim 2 further comprising:

a resilient sleeve made of resilient and soft material and having a lower end; and an upper end securely mounted on the lower open end of the main tube; and an end button mounted on the lower end of the resilient sleeve and securely connected to the actuator.

4. The press-on cosmetic container as claimed in claim 3 further comprising an outer tube mounted around the main tube and the upper end of the resilient sleeve.

5. The press-on cosmetic container as claimed in claim 1, wherein the main tube comprises a guiding tube having an inner surface, an upper peripheral edge, and a lower end; and an outer mounting tube having an inner surface and a lower peripheral edge corresponding to and securely connected to the upper peripheral edge of the guiding tube;

the positioning protrusions and the sliding slots of the main tube are formed on the inner surface of the guiding tube; and the limiting protrusion of the main tube is formed on the inner surface of the outer mounting tube.

6. The press-on cosmetic container as claimed in claim 2, wherein the main tube comprises a guiding tube having an inner surface, an upper peripheral edge, and a lower end; and an outer mounting tube having an inner surface and a lower peripheral edge corresponding to and securely connected to the upper peripheral edge of the guiding tube;

the positioning protrusions and the sliding slots of the main tube are formed on the inner surface of the guiding tube; and the limiting protrusion of the main tube is formed on the inner surface of the outer mounting tube.

7. The press-on cosmetic container as claimed in claim 3, wherein the main tube comprises a guiding tube having an inner surface, an upper peripheral edge, and a lower end; and an outer mounting tube having an inner surface and a lower peripheral edge corresponding to and securely connected to the upper peripheral edge of the guiding tube;

the positioning protrusions and the sliding slots of the main tube are formed on the inner surface of the guiding tube; and the limiting protrusion of the main tube is formed on the inner surface of the outer mounting tube.

8. The press-on cosmetic container as claimed in claim 4, wherein the main tube comprises a guiding tube having an inner surface, an upper peripheral edge, and a lower end; and an outer mounting tube having an inner surface and a lower peripheral edge corresponding to and securely connected to the upper peripheral edge of the guiding tube;

the positioning protrusions and the sliding slots of the main tube are formed on the inner surface of the guiding tube; and the limiting protrusion of the main tube is formed on the inner surface of the outer mounting tube.

9. The press-on cosmetic container as claimed in claim 1, wherein the inner tube comprises a positioning tube having an outer surface;
an upper end;
a lower end; and
a first lateral protrusion formed on the outer surface of the positioning tube and around the upper end of the positioning tube; and
an inner mounting tube having
an outer surface;
an upper end being open;
a lower end being open; and
a second lateral protrusion formed on the outer surface of the inner mounting tube and around the lower end of the inner mounting tube, and abutting the first lateral protrusion to form the flange of the inner tube; and
the ribs of the inner tube are formed on the outer surface of the positioning tube.

10. The press-on cosmetic container as claimed in claim 2, wherein
the inner tube comprises
a positioning tube having
an outer surface;
an upper end;
a lower end; and
a first lateral protrusion formed on the outer surface of the positioning tube and around the upper end of the positioning tube; and
an inner mounting tube having
an outer surface;
an upper end being open;
a lower end being open; and
a second lateral protrusion formed on the outer surface of the inner mounting tube and around the lower end of the inner mounting tube, and abutting the first lateral protrusion to form the flange of the inner tube; and
the ribs of the inner tube are formed on the outer surface of the positioning tube.

11. The press-on cosmetic container as claimed in claim 3, wherein
the inner tube comprises
a positioning tube having
an outer surface;
an upper end;
a lower end; and
a first lateral protrusion formed on the outer surface of the positioning tube and around the upper end of the positioning tube; and
an inner mounting tube having
an outer surface;
an upper end being open;
a lower end being open; and
a second lateral protrusion formed on the outer surface of the inner mounting tube and around the lower end of the inner mounting tube, and abutting the first lateral protrusion to form the flange of the inner tube; and
the ribs of the inner tube are formed on the outer surface of the positioning tube.

12. The press-on cosmetic container as claimed in claim 4, wherein
the inner tube comprises
a positioning tube having
an outer surface;
an upper end;
a lower end; and
a first lateral protrusion formed on the outer surface of the positioning tube and around the upper end of the positioning tube; and
an inner mounting tube having
an outer surface;
an upper end being open;
a lower end being open; and
a second lateral protrusion formed on the outer surface of the inner mounting tube and around the lower end of the inner mounting tube, and abutting the first lateral protrusion to form the flange of the inner tube; and
the ribs of the inner tube are formed on the outer surface of the positioning tube.

13. The press-on cosmetic container as claimed in claim 5, wherein
the inner tube comprises
a positioning tube having
an outer surface;
an upper end;
a lower end; and
a first lateral protrusion formed on the outer surface of the positioning tube and around the upper end of the positioning tube; and
an inner mounting tube having
an outer surface;
an upper end being open;
a lower end being open; and
a second lateral protrusion formed on the outer surface of the inner mounting tube and around the lower end of the inner mounting tube, and abutting the first lateral protrusion to form the flange of the inner tube; and
the ribs of the inner tube are formed on the outer surface of the positioning tube.

14. The press-on cosmetic container as claimed in claim 6, wherein
the inner tube comprises
a positioning tube having
an outer surface;
an upper end;
a lower end; and
a first lateral protrusion formed on the outer surface of the positioning tube and around the upper end of the positioning tube; and
an inner mounting tube having
an outer surface;
an upper end being open;
a lower end being open; and
a second lateral protrusion formed on the outer surface of the inner mounting tube and around the lower end of the inner mounting tube, and abutting the first lateral protrusion to form the flange of the inner tube; and
the ribs of the inner tube are formed on the outer surface of the positioning tube.

15. The press-on cosmetic container as claimed in claim 7, wherein
the inner tube comprises
a positioning tube having
an outer surface;
an upper end;
a lower end; and
a first lateral protrusion formed on the outer surface of the positioning tube and around the upper end of the positioning tube; and
an inner mounting tube having an outer surface;

an upper end being open;

a lower end being open; and a second lateral protrusion formed on the outer surface of the inner mounting tube and around the lower end of the inner mounting tube, and abutting the first lateral protrusion to form the flange of the inner tube; and the ribs of the inner tube are formed on the outer surface of the positioning tube.

16. The press-on cosmetic container as claimed in claim 8, wherein the inner tube comprises a positioning tube having an outer surface;

an upper end;

a lower end; and a first lateral protrusion formed on the outer surface of the positioning tube and around the upper end of the positioning tube; and an inner mounting tube having an outer surface;

an upper end being open;

a lower end being open; and a second lateral protrusion formed on the outer surface of the inner mounting tube and around the lower end of the inner mounting tube, and abutting the first lateral protrusion to form the flange of the inner tube; and the ribs of the inner tube are formed on the outer surface of the positioning tube.

17. The press-on cosmetic container as claimed in claim 13, wherein the inner tube further has an O-ring mounted around the outer surface of the inner tube and abutting the limiting protrusion of the main tube.

18. The press-on cosmetic container as claimed in claim 14, wherein the inner tube further has an O-ring mounted around the outer surface of the inner tube and abutting the limiting protrusion of the main tube.

19. The press-on cosmetic container as claimed in claim 15, wherein the inner tube further has an O-ring mounted around the outer surface of the inner tube and abutting the limiting protrusion of the main tube.

20. The press-on cosmetic container as claimed in claim 16, wherein the inner tube further has an O-ring mounted around the outer surface of the inner tube and abutting the limiting protrusion of the main tube.

* * * * *